US007002109B2

(12) United States Patent
Klask

(10) Patent No.: US 7,002,109 B2
(45) Date of Patent: Feb. 21, 2006

(54) AUTOMATIC STOVE TIMER AND ALARM APPARATUS AND METHOD OF USE

(76) Inventor: Richard J. Klask, 13528-112th Street, Edmonton, Alberta (CA) T5E 5A4

( * ) Notice: Subject to any disclaimer, the term of this patent is extended or adjusted under 35 U.S.C. 154(b) by 0 days.

(21) Appl. No.: 10/899,827

(22) Filed: Jul. 26, 2004

(65) Prior Publication Data

US 2006/0016799 A1 Jan. 26, 2006

(51) Int. Cl.
*H05B 3/68* (2006.01)
*G08B 23/00* (2006.01)

(52) U.S. Cl. ..... 219/445.1; 340/500

(58) Field of Classification Search ..... 219/445.1, 219/446.1, 447.1, 448.11, 460.1; 340/500, 340/501, 506, 515, 520, 521, 522, 527; 250/474.1, 250/336.1, 338.1, 339.03, 339.04, 339.06
See application file for complete search history.

(56) References Cited

U.S. PATENT DOCUMENTS 4,255,669 A 3/1981 Naugle
4,446,455 A 5/1984 Nasawaty
4,577,181 A 3/1986 Lipscher et al.
4,775,913 A 10/1988 Ekblad
4,866,427 A 9/1989 Sciscoe
5,013,893 A * 5/1991 Goessler et al. ..... 219/445.1
5,073,701 A 12/1991 Ljunggren
5,608,378 A 3/1997 McLean et al.
5,608,383 A 3/1997 Neil
5,693,245 A 12/1997 Clizbe
5,717,188 A 2/1998 Vaillancourt
5,939,992 A 8/1999 Devries
5,945,017 A 8/1999 Cheng
6,111,228 A * 8/2000 Berkcan et al. ..... 219/446.1
6,130,413 A 10/2000 Rak
6,140,617 A * 10/2000 Berkcan et al. ..... 219/446.1
6,140,620 A 10/2000 Aldridge
6,281,481 B1 * 8/2001 Tiemann ..... 219/446.1
6,294,994 B1 9/2001 Hoellrich
6,323,777 B1 * 11/2001 Durston et al. ..... 340/679
6,420,969 B1 7/2002 Campbell

* cited by examiner

*Primary Examiner*—Sang Paik
(74) *Attorney, Agent, or Firm*—Gene Scott and Patent Law & Venture Group

(57) ABSTRACT

A burner sensor is electrically interconnected with a control circuit, the burner sensor enabled for detection of burner operation, the control circuit providing a timing feature enabled, during burner operation, for continuous repetitive timing cycles each for a fixed selected time interval and for activating at least one of an audio, i.e., buzzer, and a visual alarms for a fixed duration, at the completion of each of the timing cycles. Thus the operator is alerted to the fact that a heating coil is hot so that a significant burn and fire hazard is avoided.

12 Claims, 3 Drawing Sheets

AUTOMATIC STOVE TIMER AND ALARM APPARATUS AND METHOD OF USE

INCORPORATION BY REFERENCE

Applicant(s) hereby incorporate herein by reference, any and all U.S. patents and U.S. patent applications cited or referred to in this application.

BACKGROUND OF THE INVENTION

1. Field of the Invention:

This invention relates generally to safety apparatus and in particular to such protective devices for commercial and residential electric ranges or stoves.

2. Description of Related Art:

The following art defines the present state of this field:

Naugle, U.S. Pat. No. 4,255,669 describes a sensing apparatus for monitoring the operation of an electrical appliance. The sensing apparatus is plugged into a standard electrical outlet and the appliance to be monitored is plugged into the sensing apparatus. The appliance current flows through a transformer in the sensing apparatus. Detection circuitry including a comparator produces one signal when current flow through the transformer is negligible (appliance off) and another signal when the current flow through the transformer is significant (appliance on). Transistor circuitry connected to the detection circuitry produces a pulse at one output terminal on a transition from the one signal to the other signal from the detection circuitry (appliance turned on) and produces a pulse at another output terminal on a transition from the other signal to the one signal from the detection circuitry (appliance turned off).

Nashawaty, U.S. Pat. No. 4,446,455 describes an alarm system for use in a stove having a burner and control device for turning on and off the burner, including an audio/visual alarm device and an alarm circuit for activating the alarm device. A low-voltage power supply energizes the alarm circuit. A sensor is mounted with the burner for sensing the presence and absence of a utensil thereon. A first switch in the alarm circuit closes a first set of contacts in response to the control device being in the burner-on position. A second switch in the alarm circuit closes a second set of contacts in the absence of a utensil on the burner, thereby completing the alarm circuit and activating the audio/visual alarm device.

Lipscher et al., U.S. Pat. No. 4,577,181 describes an alarm system for an electric range which detects when a burner is energized without a utensil in place on the burner wherein the sensing means comprises an electrical switch mounted below the stovetop having a first switch position and a second switch position, a pin slidably passing through an opening in the stovetop beneath the rim of the dish under the heating element in contact with the underside of the rim and biased against the rim with a pressure sufficient to lift the rim from the stovetop when no utensil is present on the heating element, but insufficient to lift the rim when a utensil is in place on the heating element; and means connecting said pin with the switch to operate the switch between first and second positions corresponding to the position of the pin when a utensil is present or absent from the heating element.

Ekblad, U.S. Pat. No. 4,775,913 describes a control device for controlling the operation of an object of cooking such as a stove or the like. The presence of a user in the area of the stove is detected. When the user is present, the stove operation is enabled. After the user has been absent from the area for a first predetermined time, the stove is temporarily disabled, an again enabled when the user enters the area. If the user is absent from the area of the stove for a second predetermined time, the stove is permanently disabled, so that it cannot again be enabled until manually reset.

Sciscoe, U.S. Pat. No. 4,866,427 describes a temperature alarm for attachment around the exterior of the flue pipe of a wood-burning or similar stove, with alarm activation temperature selected by slidable adjustment along the flue pipe. A bimetal thermostat is mounted in close proximity to the flue pipe, and acts to close an electrical connection between thermally protected power supply and acoustic horn. A system test circuit is provided.

Ljunggren, U.S. Pat. No. 5,073,701 describes an arrangement in a range, a cooking hob or the like having at least one electrically heated hot plate and/or oven, comprising a manually operable setting system for the setting of a desired power or temperature for the hot plate or the oven. A detecting system is arranged to detect changes in the setting of the setting system. A timing system co-operates with the detecting system to be activated by the latter. A switching system co-operates with the timing system to disconnect the power to the hot plate or the oven on the reaching of an end time determined by the timing system, said timing system being reset each time the detecting system is activated and then operated to start counting towards the predetermined end time.

McLean et al., U.S. Pat. No. 5,608,378 describes a fire-preventing warning system for alerting an occupant leaving the premises that a stove burner is on, includes (a) a sensor to detect whether a gas or electric stove is "on", connected to (b) a warning indicator located by the exit door. If the stove burner is on, the warning indicator will light up, or, in the alternative, emit an audible warning, or both, as the door is opened. The sensor and the indicator circuitry may be connected by electrical conductors or by radio frequency transmission; the system may be battery-operated or powered from household current.

Neil, U.S. Pat. No. 5,608,383 describes an automatic temperature alarm system for alerting an operator of a heated apparatus that the apparatus has been heated and untouched for an excessive period of time. In a particular embodiment, the invention comprises a temperature sensor affixed to the heated apparatus that senses its temperature; a vibration sensor that senses motion of the apparatus; a horn to alert the operator; and a system control intelligence in communication with the temperature and vibration sensors and horn for setting an alarm timer to measure an alarm period in response to sensed temperatures and motions and for activating the horn upon expiration of the alarm period. In use of the automatic temperature alarm system, the system control intelligence is operated so that whenever the temperature sensor senses an increase beyond a specific high or trigger temperature, such as a heating temperature of an outdoor barbecue, the system control intelligence sets its alarm timer to commence measurement of the alarm period of time, and upon the expiration of the alarm period of time, for example twenty minutes, the system control intelligence activates the horn. If the system control intelligence senses a motion of the apparatus from the vibration sensor during the alarm period of time, however, it re-sets its alarm timer to re-commence measurement of the alarm period of time. If the horn has been activated, the system control intelligence inactivates it upon sensing any apparatus motion from the vibration sensor.

Clizbe, U.S. Pat. No. 5,693,245 describes an integral electric range surface burner control switch user interface made up of two components. The first component, which controls the burner temperature setting, is a standard knob which is rotated to turn the burner on, as well as set the desired temperature of the particular surface burner. The second component is a timer control ring integrally mounted around the surface burner temperature control knob. The timer control ring is concentric with and has the same central axis as the surface burner temperature control knob, and is rotatable to set the desired cooking time for the particular surface burner. When the selected amount of time expires, the power to the surface burner element is automatically disconnected and the surface burner is disabled, thus requiring a resetting of the timer for further use.

Vaillancourt, U.S. Pat. No. 5,717,188 describes a safety device for electric stoves and ovens wherein there is provided a sensor for sensing when the stove is heating at a certain rate which could constitute a safety hazard and a sensing means for detecting the presence of a person within a predetermined area proximate the stove. When a certain period of time passes without motion by a person in the predetermined area while the stove is in the predetermined operating condition, power to the stove can be reduced.

Devries et al., U.S. Pat. No. 5,939,992 describes a safety apparatus for electric appliances which includes a sensor for sensing that an electric appliance is operating. An alarm coupled with the sensor, whereby an alarm is initiated. A manually operated alarm disabling switch permitting a person supervising the operation of the electric appliance to temporarily disable the alarm for a predetermined time interval.

Cheng, et al. U.S. Pat. No. 5,945,017 describes an electric or gas burner that can be improved by the installation of an automated fire safety device that first determines whether the burner is being attended to and if not, senses the temperature of the cooking utensil on it and automatically shuts off the flow of electricity or gas to the burner when the temperature of the cooking utensil begins to exceed a predetermined temperature range. A motion detector is integrated into the safety device and serves as the front-end to a temperature sensor switch. The switch is designed to trigger a power shut-off mechanism when high utensil temperature is encountered. The mechanism will be deactivated if motion is detected within a set periphery of the stove appliance. It will automatically be reactivated a set time later after no motion is detected. This invention will not interfere with normal cooking procedures while drastically reducing the possibility of kitchen fires due to cooking.

Rak, U.S. Pat. No. 6,130,413 describes a safety device for use in conjunction with an electric cooking stove including a relay unit having a plug having two live pins and a neutral pin for insertion in a stove receptacle, a receptacle receiving a similar plug of a stove, a relay arrangement for interrupting connections between the live pins of the plug, and corresponding live sockets of the receptacle; and a control unit connected to the relay arrangements, the control unit generating signals to activate said relay arrangement; the relay arrangement is configured to interrupt only one at a time of the connections between the live pins and the live sockets, and the relay arrangement further includes preset switch or jumper to select which of said connections is interrupted. The control unit preferably includes a device to detect the presence of a person in the vicinity of the stove and a timer which restarts a count-down whenever the detection a device fails to detect a person, and causes the control unit to send a signal to the relay arrangements on completing the count-down.

Aldridge et al., U.S. Pat. No. 6,140,620 describes a device for disconnecting an electric appliance or a component thereof from a source of electricity including a circuit connecting the appliance or component thereof to a power source through a relay or other component to open the circuit; and a timer circuit connected to the relay. The timer circuit includes a processor for setting the timer circuit, and a manually operated switch in communication with the processor. The timer circuit is activated for a predetermined time increment by closing the switch, and the relay is closed while the timer circuit is activated. When the switch is closed again while the timer circuit is activated, an additional time increment is added to the activation period.

Hoellerich, U.S. Pat. No. 6,294,994 describes an attendance monitoring apparatus for an appliance, such as an electrical appliance, and includes a housing and a motion sensor assembly contained in the housing. A timer assembly is electrically connected to the motion sensor assembly, and an alarm assembly is electrically connected to the timer assembly. The timer assembly is adjustable for selecting a range of predetermined time intervals. Optionally, a current controller is electrically connected to the timer assembly. The current controller controls electric power to the appliance, such as an electric stove. The attendance monitoring apparatus of the invention signals a person with an audible alarm when the person has not attended to the electric stove for a predetermined period of time. Optionally, the attendance monitoring apparatus can turn off electrical power to the stove under these conditions. In this way, the attendance monitoring apparatus of the invention increases an operator's freedom and electric stove safety when the stove is in use. As a result, the attendance monitoring apparatus can prevent fires and save lives.

Campbell, U.S. Pat. No. 6,420,969 describes a system for arming and disarming a central intrusion alarm system control utilizing the activation status of a particular appliance. The system employs a detector for determining the position of an on-off switch associated with a particular appliance. The regulator prevents the operation of the arming control in a central intrusion alarm system when the detector determines that the appliance is "on". The system of the present invention may be employed with multiple appliance switches. In addition, transmission of the disarming signal to the central intrusion alarm arming control may be accomplished through hard wires or by radio transmission.

Our prior art search with abstracts described above teaches: a safety apparatus for electric appliances, a sensing apparatus, an appliance alarm system, an appliance attendance monitoring apparatus, an appliance timer, a safety device for electric stoves, a fire safety device for stove-top burners, a safety device for a heating appliance, an electric range temperature control with mandatory timer, an automatic temperature alarm system, an electric stove warning system, an arrangement in a range or cooking hob with temperature control, timer, detector and switching system, a temperature alarm, a safety shutoff device for a stove, an alarm system for an electric range, and a stove alarm system, but does not teach a retrofitted apparatus capable of continuous alarm notice of burner activity with both audio and visual features. The present invention fulfills these needs and provides further related advantages as described in the following summary.

SUMMARY OF THE INVENTION

The present invention is an apparatus and method of use of the apparatus. The primary purpose of the invention is to assure the safety in use of an electric range, although the invention may be applied to many other applications in both the consumer market and the industrial/commercial market. For instance, we have discovered through use that once the reset switch of the present invention is made a part of a cooking routine it is very effective to use it in timing cooking functions. Since electric ranges generally have indicator lights or lamps to enable a visual recognition when a burner is in use, certain aspects of the present invention may, at first, appear redundant. However, one may recognize that many stove burns occur when an electric coil resistance heater type electric range is used primarily because the coil does not appear to be hot until it is turned to a quite high temperature. The present invention overcomes this drawback by providing much brighter warning lamp. A burner sensor is electrically interconnected with a control circuit, the burner sensor enabled for detection of burner operation, the control circuit providing a timing feature enabled, during burner operation, for continuous repetitive timing cycles each for a fixed selected time interval and for activating at least one of an audio, i.e., buzzer, and a visual alarms for a fixed duration, at the completion of each of the timing cycles. Thus the operator is alerted to the fact that a heating coil is hot so that a significant burn and fire hazard is avoided. The present invention teaches certain benefits in construction and use which give rise to the objectives described below.

A primary objective of the present invention is to provide an apparatus and method of use of such apparatus that yields advantages not taught by the prior art.

Another objective is to provide such an invention capable of avoiding burns from touching a hot electric range burner.

A further objective is to provide such an invention capable of preventing a fire due to forgetting to turn off an electric range after cooking is completed.

A still further objective is to provide such an invention capable of simple and quick installation without modifying the wiring and hardware of an electric range.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
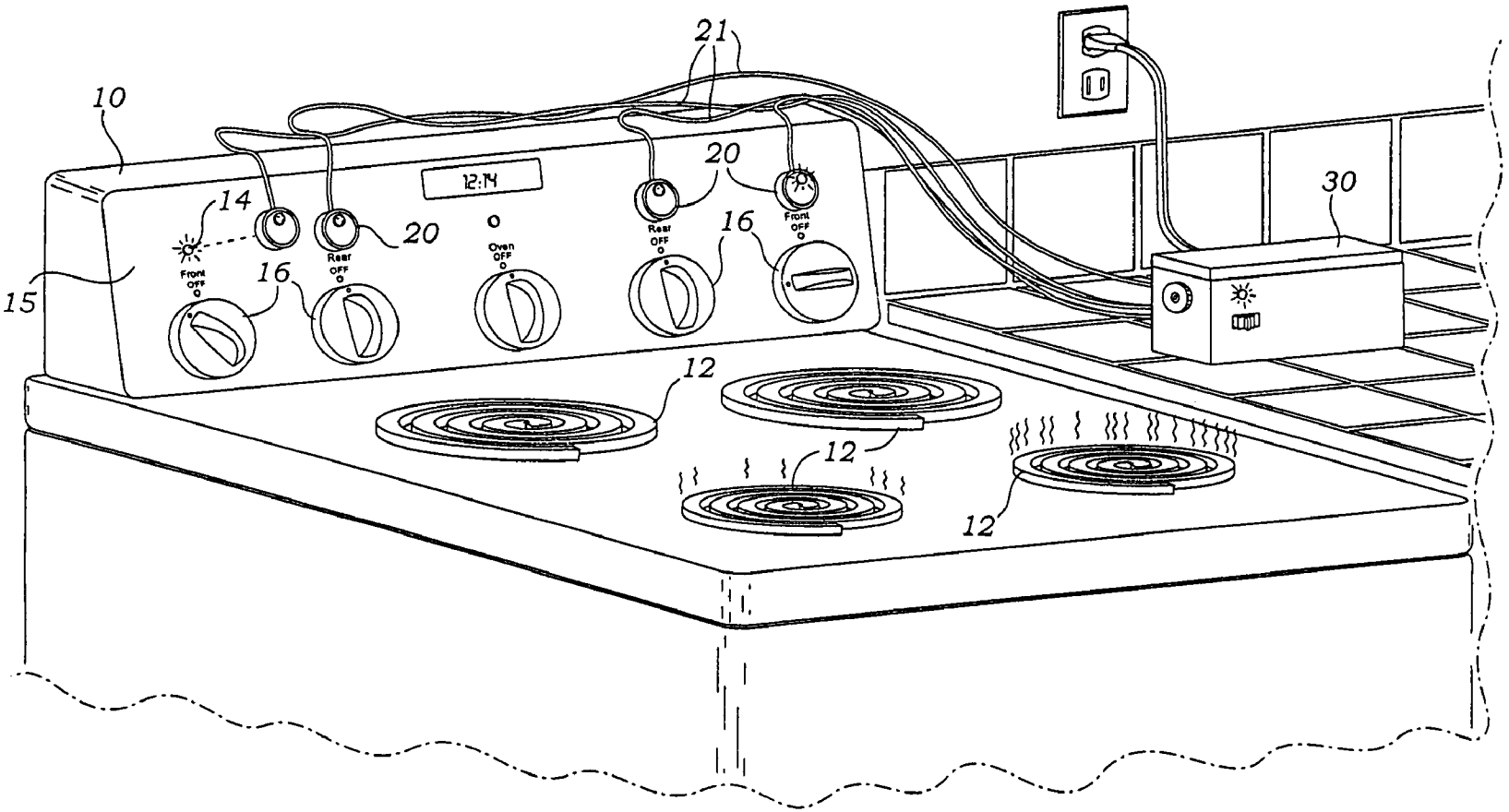
FIG. 1 is a perspective view of the invention as applied to an electric range.

The present invention is an apparatus for providing safety and alert management to electrical appliances and particularly an electrical stove or range. As shown in FIG. 1, range 10 has cooking coils 12, typically 4 or 6 such coils 12, and range indicator lamps 14 to indicate when a coil 12 is in the "on" state. In many commercially available stoves, there may be fewer range indicator lamps 14 than cooking coils 12, so that a single range indicator lamp 14 may be used to indicate when one or another or all of certain ones of the heating coils 12 have electrical energy applied to them and are being heated.

Figure 3:
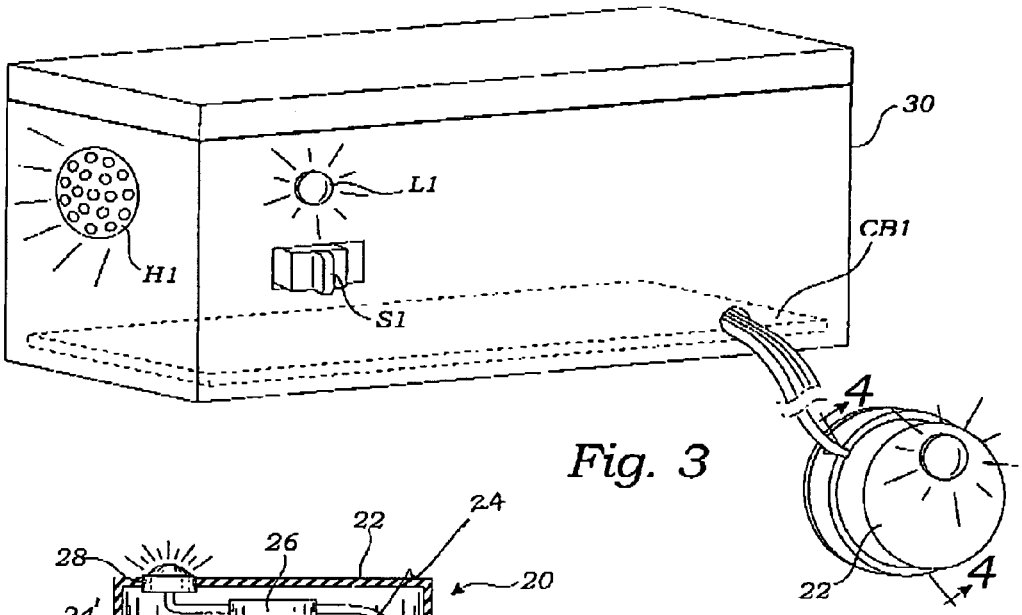
FIG. 3 is a perspective view of a control box thereof showing its connection to one optical coupling.
Figure 5:
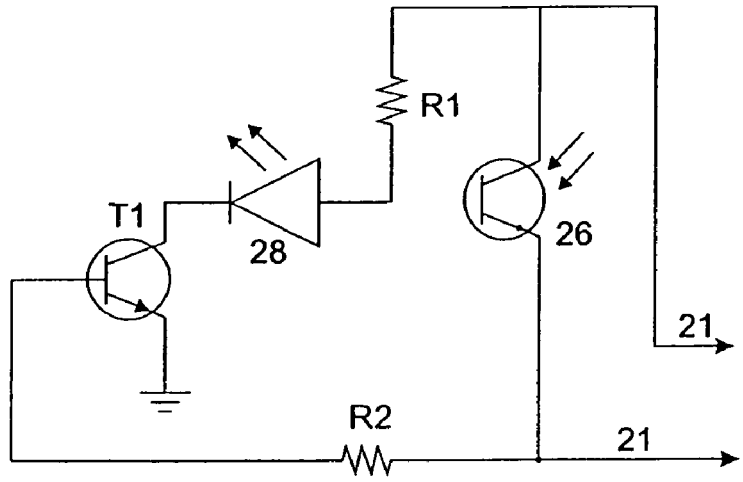
FIG. 5 is an electrical circuit representation of elements shown in FIG. 4.
Figure 6:
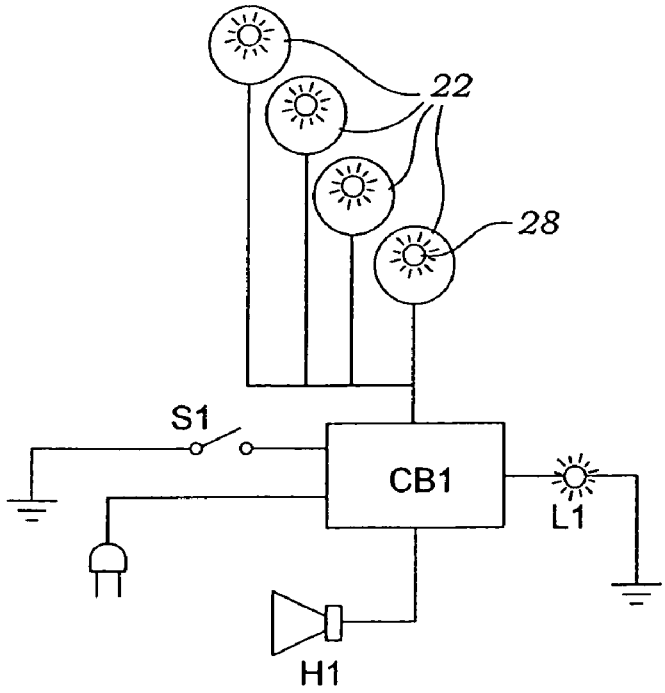
FIG. 6 is an electrical block diagram of the invention.

As shown in FIG. 6, the present invention is an electrical circuit primarily housed on circuit board (CB1) in an enclosure 30 which is shown in FIGS. 1 and 3. The circuit provides sensors 26, shown in FIGS. 4 and 5 which are positioned to sense when range indicator lamps 14 are illuminated. The electrical circuit provides a timer as part of CB1 which is enabled for continuous repetitive fixed timing cycles, and such enablement is well known in the art. At the end of each of the timing cycles an audio component such as buzzer H1, and/or a visual component, such as alert lamp 28 are activated so as to alert those in proximity that a timing cycle has just completed. Such timing and activating circuits are well known in the art and are therefore not shown here, but, as stated, are part of the circuit on circuit board CB1. Preferably, buzzer H1 is loud enough to be heard in household locations distant from the cooking area (kitchen) and yet not so loud as to be bothersome when a person is present in the cooking area. These alerts advise that a timing period, typically 5 minutes, but which may be set as desired, has elapsed since the last alert and that at least one of the cooking coils 12 is still active and therefore, hot. Preferably, the alert lamp is preferably an LED lamp that is bright enough so that it is highly visible to one standing in proximity. To improve the ability to see alert lamp 28 it may be made to blink using a blink rate circuit of any type that is well known.

Figure 4:
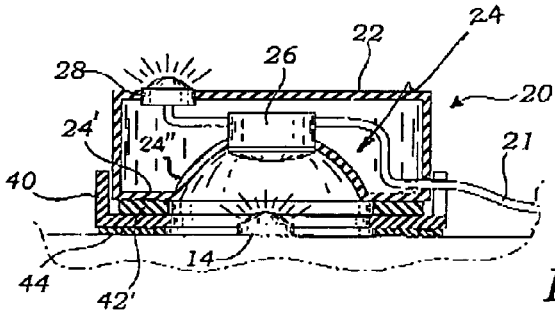
FIG. 4 is a cross-sectional view taken along line 4—4 in FIG. 3.

Preferably, the sensors 26, as best seen in FIG. 4, are each mounted over one of the range indicator lamps 14 on the range 10. As understood from FIG. 1 each of the range's control knobs 16 controls power to one of the cooking coils 12. When a cooking coil 12 is in the "on" state, an associated range indicator lamp 14 is illuminated. Unfortunately, range indicator lamps 14 are usually too small and dim to be of real use in monitoring the cooking coils 12. This situation is very well known given the number of times such cooking coils 12 are inadvertently left in the "on" state when a kitchen is not in use. Thus, the present invention is a means for saving energy lost in this way.

Preferably, each of the sensors 26 is mounted within a metal housing 22, preferably of a ferromagnetic material such as steel, (FIGS. 2–4), by a means for mounting such as bracket 24 (FIG. 4), and is positioned over one of the indicator lamps 14. As can be seen in FIG. 4, the bracket 24 is integral with housing 22. Bracket 24 provides a flat flange portion 24' which is shown in face-to-face contact with magnet 42' in FIG. 4: and it also has a concave portion 24" which may be described as a well within which sensor 26 is mounted and, as shown, positioned symmetrically at the center of the well. Because sensor 26 is positioned within the well it is sheltered by the concave portion 24' from ambient light which might cause a false reading by sensor 26 even when indictor lamp 14 is not illuminated. Sensor 26, therefore, is able to sense when one of the range indictor lamps 14 is illuminated, and alert lamp 28 is then illuminated as a direct response. The lamp 28 is preferably an LED or any well known type and has much greater illumination output than the typical range indicator lamp 14. As seen in FIG. 4 in cross-section, the housing 22 is preferably a round case.

FIG. 5 is a partial schematic diagram showing components 26 and 28. When sensor 26 senses light input from range indicator lamp 14, it is turned off and this enables transistor switch T1, in series with alert lamp 28, to conduct. Therefore, when range indicator lamp 14 is in the "on" state, alert lamp 28 is as well. Sensor 26 provides the functions of sensing illumination from range indicator lamp 14 and placing into operation the portion of the control circuit CB1 that enables alert lamp 28. Assuming that alert lamp 28 is considerably larger or brighter than indicator 14, this enablement provides the advantage of an improved visual alert function.

Figure 2:
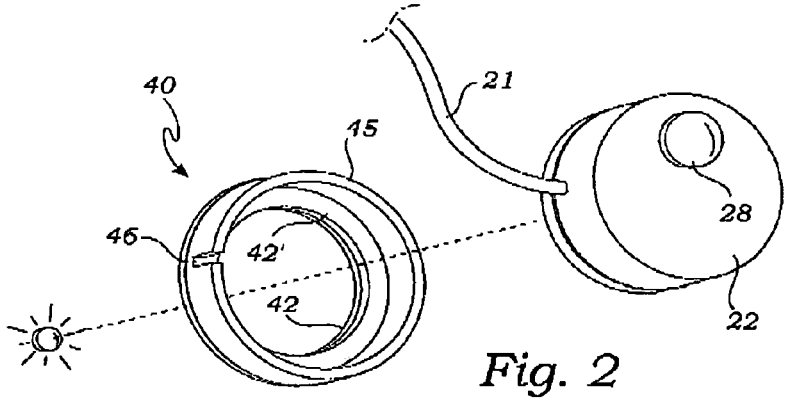
FIG. 2 is an exploded perspective view of an optical coupling unit thereof.

As best seen in FIG. 2, a base unit 40 is comprised of a ring 42 with side wall 45 into which housing 22 is engaged. As can be seen in FIG. 4, the side wall 45, which as shown, is peripheral to housing 22 so as to further shade sensor 26 from ambient light. The side wall 45 is notched (element 46) to accept an electrical cable 21. The base unit 40 is mounted to the range panel 15 (FIG. 1) by double sided tape 44 or any other means that will enable it to be held securely in place. Within base unit 40 is the ring magnet 42' previously mentioned, which holds housing 22, including bracket 24, in place by magnetic attraction. Since the elements shown in FIG. 4 having reference numerals 44, 40, 42', 24', 24" and 22, are all circularly symmetrical as shown in FIG. 2 and are in face-to-face contact it is clear that the only illumination visible to sensor 26 is indictor lamp 14, ambient light, such as from range coils and kitchen lighting being excluded.

FIG. 6 is a schematic block diagram of the invention, showing S1 a reset switch, the buzzer H1 and AC power indicator lamp L1. The circuit board CB1 contains AC rectification and current limiting elements, etc. as is very well known in AC circuits. Appropriate timing and programmable timing circuits, and alarm circuits applicable to the present invention are found in The Encyclopedia of Electronic Circuits, volumes 1–5, 15$^{th}$ printing, 1985, by Rudolf F. Graf and published by TAB BOOKS, Division of McGraw-Hill, Inc., Blue Ridge Summit, PA. This set of texts is hereby incorporated by reference into this patent application.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. In an electric cooking range having a range indicator lamp mounted on a range panel, wherein the indicator lamp is illuminated when a cooking coil or the range is in an on state, an alert management apparatus comprising: a light sensor mounted on a bracket within a housing, the housing supported by the range panel in a position where the light sensor is adjacent to the indictor lamp and sheltered from ambient light; a control circuit including the light sensor, an alert lamp having greater illumination than the indictor lamp, an alarm means and a timer, the timer enabled, during operation of the cooking coil, for continuous cycling of a repetitive timing interval of a selected time duration, and for activating the alert means, at the completion of each said timing interval.

2. The apparatus of claim 1 wherein the alarm means is at least one of a blinking lamp and a buzzer.

3. The apparatus of claim 1 wherein the bracket is concave thereby forming a well, the well formed within a flange, the light sensor positioned centrally within the well.

4. The apparatus of claim 3 further comprising a ring magnet, the bracket flange secured to the ring magnet.

5. The apparatus of claim 4 further comprising a base unit having a ring with an annular side wall, the ring secured to the range panel and centered on the indicator lamp, and by magnetic attraction, the ring magnet sandwiched between the ring of the base and the flange of the bracket for securing the light sensor and the alert lamp on the range panel.

6. The apparatus of claim 5 wherein the bracket is integral with a housing, the side wall of the base unit peripheral to the housing and bracket.

7. In an electric cooking range having a range indicator lamp mounted on a range panel, wherein the indicator lamp is illuminated when a cooking coil of the range is in an on state, an alert management method comprising the steps of: mounting a light sensor on a bracket within a housing; supporting the housing on the range panel so as to position the light sensor adjacent to the indictor lamp; sheltering the light sensor from ambient light; establishing a control circuit including the light sensor, an alert lamp having greater illumination than the indictor lamp, an alarm means and a timer; continuously cycling the timer during operation of the cooking coil with a repetitive timing interval of a selected time duration; and activating the alert means, at the completion of each timing interval.

8. The method of claim 7 comprising the further step of forming the alarm means as at least one of a blinking lamp and a buzzer.

9. The method of claim 7 comprising the further step of forming the bracket as a concave well formed within a flange and positioning the light sensor centrally within the well.

10. The method of claim 9 comprising the further step of securing the bracket flange with a ring magnet.

11. The method of claim 10 comprising the further step of providing a base unit having a ring with an annular side wall; securing the ring to the range panel centered on the indicator lamp; sandwiching by magnetic attraction the ring magnet between the ring of the base and the flange of the bracket thereby securing the light sensor and the alert lamp on the range panel.

12. The method of claim 11 comprising the further step forming bracket integrally with a housing and positioning the side wall of the base unit peripheral to the housing and bracket.

* * * * *